US008840419B2

(12) United States Patent
Huang

(10) Patent No.: US 8,840,419 B2
(45) Date of Patent: Sep. 23, 2014

(54) COMMUNICATION CONNECTOR WITH TAB OPERATING MECHANISM

(71) Applicant: Kui-Hsien Huang, Taipei (TW)

(72) Inventor: Kui-Hsien Huang, Taipei (TW)

( * ) Notice: Subject to any disclaimer, the term of this patent is extended or adjusted under 35 U.S.C. 154(b) by 71 days.

(21) Appl. No.: 13/688,141

(22) Filed: Nov. 28, 2012

(65) Prior Publication Data

US 2014/0148039 A1 May 29, 2014

(51) Int. Cl.

| | |
|---|---|
| ***H01R 13/625*** | (2006.01) |
| ***H01R 13/627*** | (2006.01) |
| *H01R 24/64* | (2011.01) |
| *H01R 13/639* | (2006.01) |

(52) U.S. Cl.

CPC ..... *H01R 13/6272* (2013.01); *H01R 24/64* (2013.01); *H01R 13/639* (2013.01)

USPC ..... 439/352

(58) Field of Classification Search

USPC ..... 439/344, 352, 354, 353; 385/56, 55

See application file for complete search history.

(56) References Cited

U.S. PATENT DOCUMENTS

| | | | | |
|---|---|---|---|---|
| 5,579,425 | A * | 11/1996 | Lampert et al. | 385/59 |
| 6,017,153 | A * | 1/2000 | Carlisle et al. | 385/56 |
| 6,196,733 | B1 * | 3/2001 | Wild | 385/86 |
| 6,364,685 | B1 * | 4/2002 | Manning | 439/357 |
| 6,550,979 | B1 * | 4/2003 | Fleenor et al. | 385/78 |
| 6,554,487 | B2 * | 4/2003 | Nolan | 385/78 |
| 6,565,262 | B2 * | 5/2003 | Childers et al. | 385/76 |
| 6,866,532 | B1 * | 3/2005 | Huang | 439/344 |
| 6,918,782 | B2 * | 7/2005 | Foster | 439/352 |
| 6,994,580 | B1 * | 2/2006 | Chen | 439/344 |
| D523,396 | S * | 6/2006 | Shiraishi et al. | D13/133 |
| 7,101,212 | B1 * | 9/2006 | Larkin | 439/344 |
| 7,326,075 | B1 * | 2/2008 | Armstrong et al. | 439/354 |
| 7,510,419 | B1 * | 3/2009 | Sullivan et al. | 439/344 |
| 7,704,091 | B2 * | 4/2010 | Millan | 439/344 |
| RE41,933 | E * | 11/2010 | Cheng et al. | 385/56 |
| 8,025,519 | B2 * | 9/2011 | Handshaw et al. | 439/352 |
| 8,152,385 | B2 * | 4/2012 | de Jong et al. | 385/71 |
| 8,506,174 | B2 * | 8/2013 | Nakagawa | 385/78 |
| 2005/0124201 | A1 * | 6/2005 | Lo et al. | 439/352 |

* cited by examiner

*Primary Examiner* — Alexander Gilman
(74) *Attorney, Agent, or Firm* — Leong C. Lei

(57) ABSTRACT

A communication connector comprises a connector body and a tab operating mechanism. The connector body has a locking tab at a front top portion thereof and is fitted to a case at a rear portion thereof, wherein the case is provided with a pivot portion. The tab operating mechanism includes a press member and spring means. The press member is pivotally mounted to the pivot portion of the case. The spring means is disposed between the case and the locking tab for engaging with the locking tab from a lower position. With the present invention, the spring means can assist the locking tab 11 to return to its normal position, while the press member can limit the locking tab within an angle for protecting the locking tab from being overly bent by improper external force. Such features make the present invention a robust and reliable communication connector.

4 Claims, 7 Drawing Sheets

COMMUNICATION CONNECTOR WITH TAB OPERATING MECHANISM

TECHNICAL FIELD OF THE INVENTION

The present invention relates to a communication connector and, more particularly, to a communication connector for use in telecommunication or network system, wherein a tab operating mechanism is provided for assisting a locking tab of the connector to return to its normal position for allowing the connector to connect with a port properly.

DESCRIPTION OF THE PRIOR ART

In telecommunication or network applications, communication connectors are a basic component for connecting a variety of devices. As shown in FIG. 7, a conventional communication connector (A10) generally has a locking tab (A1) and a plurality of slots (A2) for electrical contacts that can be electrically wired to a cable (A3). In use, the locking tab (A1) can be depressed by a user, so that the connector (A10) can be inserted into a corresponding communication port of a device. After inserting the connector (A10) and releasing the locking tab (A1), the locking tab (A1) can return to its normal position by its elasticity to allow the connector (A10) to be held in the communication port.

The conventional communication connector, being a standard connector, is not allowed to change the structure of the locking tab (A1). Under this condition, the conventional communication connector has the following disadvantages:

1. The connector (A10) is usually made of polycarbonate (PC) material. Although this material has good elasticity, it does not have sufficient toughness for use in connectors. The locking tab (A1) of the connector (A10) is prone to breakage or fragmentation, especially under improper external force, thereby causing the associated communication cable unable to connect with a communication port properly.

2. The locking tab (A1) of the conventional connector (A10) can be bent by improper external force to cause the extending angle of the locking tab (A1) to be excessively large or small, thereby causing the conventional connector (A10) unable to be inserted into a communication port properly 3. Since the exposed portion of the locking tab (A1) may be too short after the conventional connector (A10) is inserted into a communication port, it is inconvenient for a user to depress the locking tab (A1) again for removing the connector (A10) from the communication port. Besides, during the removal operation, the locking tab (A1) may damage the user's fingernails.

In view of the foregoing, there is a modified connector, being made of polyoxymethylene (POM) material, available on the market for mitigating the problems of the locking tab (A1) of the conventional connector (A10). However, in the modified connector, although the toughness of the locking tab can be increased, the elasticity of the locking tab can be compromised. Thus, the locking tab sometimes cannot return to its normal position, thereby causing an improper connection between the connector and a communication port.

SUMMARY OF THE INVENTION

The present invention provides a communication connector, which generally comprises a connector body and a tab operating mechanism. The connector body has a locking tab at a front top portion thereof and is fitted to a case at a rear portion thereof, wherein the case is provided with a pivot portion. The tab operating mechanism includes a press member and spring means. The press member has a rear end pivotally mounted to the pivot portion of the case and has a front end placed over the locking tab of the connector body, so that the press member can rotate about the pivot portion of the case. The spring means is disposed between the case and the locking tab for engaging with the locking tab from a lower position, wherein the rear end of the press member is provided with a stopper to limit the press member to a predetermined angle with respect to a top surface of the case. The press member can limit the locking tab within an angle so as to protect the locking tab from being overly bent by improper external force.

In use, when the press member is depressed by a user, the spring means, being placed under the locking tab, can be compressed by the locking tab to store energy. Therefore, when the press member is released, the spring means can drive the locking tab to move upwardly, thereby causing the locking tab to return to its normal position. In brief, the locking tab is located between the press member and the spring means, wherein the locking tab is subject to an upward force from the spring means and a downward force from the press member.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
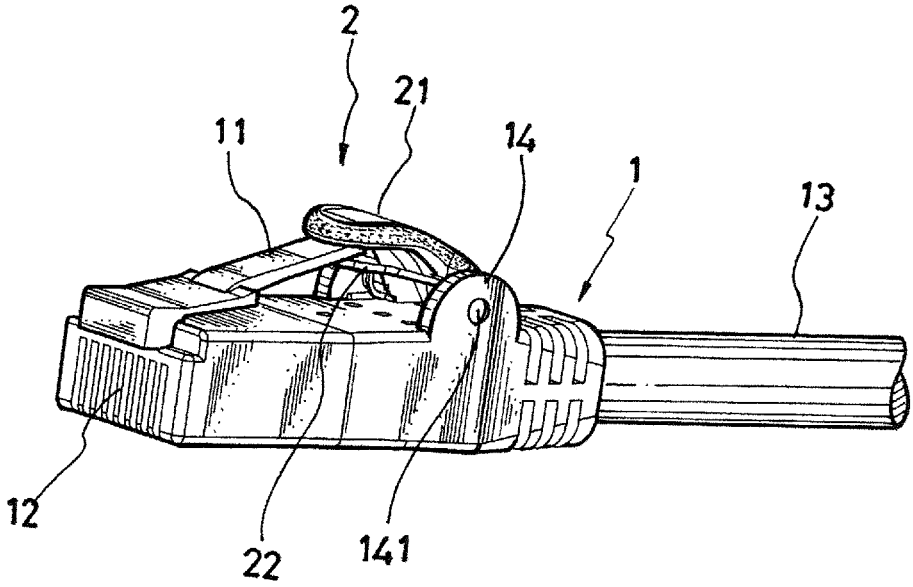
FIG. 1 shows a 3-dimensional view of one embodiment of the present invention.
Figure 2:
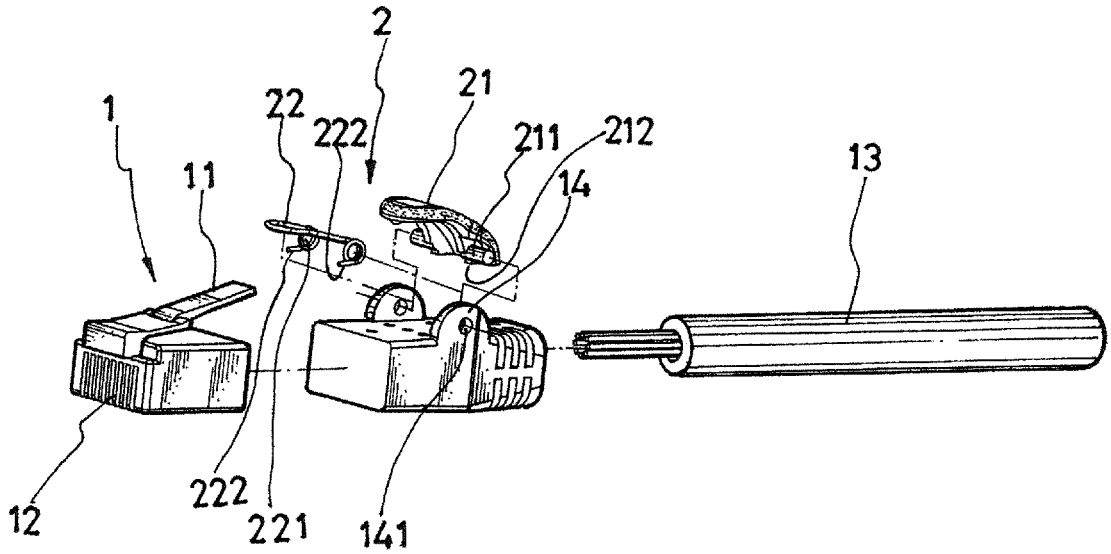
FIG. 2 shows an exploded view of the embodiment of the present invention.
Figure 3:
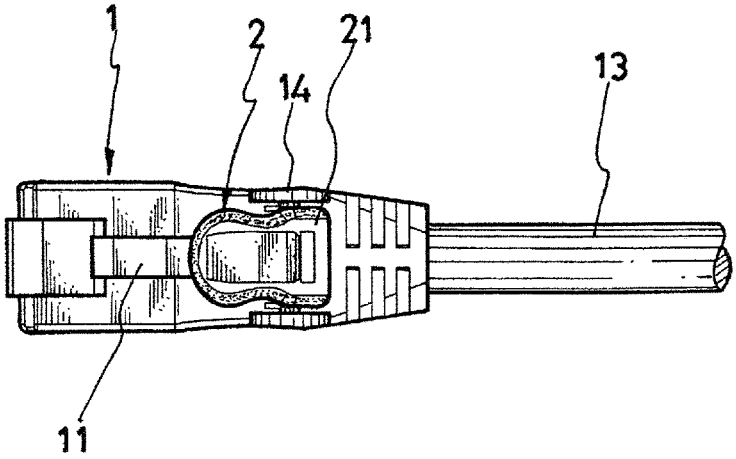
FIG. 3 shows a top view of the embodiment of the present invention.

Referring to FIGS. 1, 2, and 3, a communication connector according to one embodiment of the present invention is shown, which generally comprises a connector body 1 and a tab operating mechanism 2. The connector body 1 has a locking tab 11 at a front top portion thereof. A plurality of slots 12 for electrical contacts are defined at a front portion of the connector body 1. As shown, the electrical contacts in the slots 12 can be wired to a cable being indicated by reference number 13. The rear portion of the connector body 1 can be fitted to a case that is provided with a pivot portion 14 for pivotally connected with the tab operating mechanism 2.

The tab operating mechanism 2 includes a press member 21 and spring means 22. The press member 21 has a rear end pivotally mounted to the pivot portion 14 and has a front end placed over the locking tab 11 of the connector body 1, wherein the spring means 22 is disposed between the case and the locking tab 11 for engaging with the locking tab 11 from a lower position. The press member 21 can be provided with a pair of pivot pins 211 respectively at two lateral sides thereof, and the pivot portion 14 can be provided with a pair of pivot holes 141. The pivot pins 211 of the press member 21 can be fitted into the pivot holes 141 of the pivot portion 14, so that the press member 21 can rotate about the pivot portion 14. Alternatively, the press member 21 can be provided with a pair of pivot holes respectively at two lateral sides thereof, and the pivot portion 14 can be provided with a pair of pivot pins, to achieve the same purpose of allowing the press member 21 to rotate about the pivot portion 14. Furthermore, the rear end of the press member 21 can be provided with a stopper 212 to limit the press member 21 to a predetermined angle with respect to a top surface of the case. The predetermined angle of the press member 21 would define the maximum angle that the locking tab 11 can reach while the connector is in application, so that the locking tab 11 can be limited within the maximum angle.

In the present invention, the spring means 22 can be a torsional spring provided with a pair of central holes 221 that are coaxially aligned, and a pair of extending legs 222 each at one side of one central hole. The central holes 221 can be respectively fitted around the two pivot pins 211 of the press member 21, and the extending legs 222 can base on the top surface of the case to enable the torsional spring 22 to exert an upward force to the locking tab 11 of the connector body 11, so that, when the press member 21 is released after it is inserted into a communication port, the locking tab 11 can be moved upwardly by the torsional spring 22 and thus can be returned to its original position and locked with the communication port.

Figure 4:
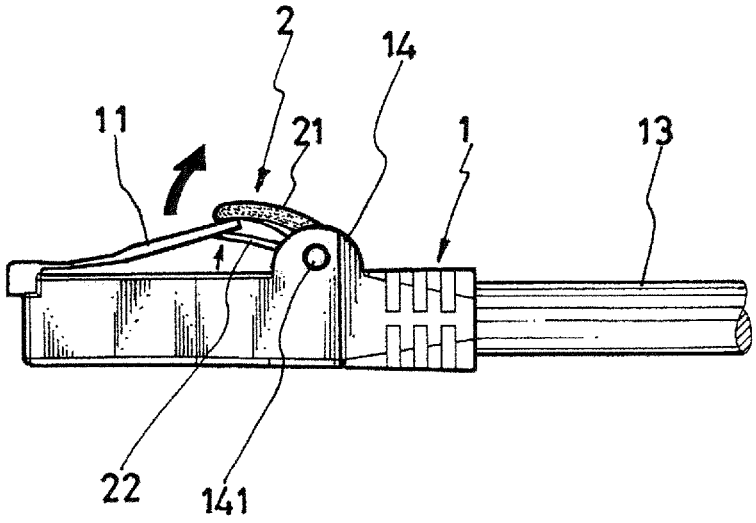
FIG. 4 shows a working view of the embodiment of the present invention, wherein the spring means can drive the locking tab to move upwardly when the press member is released.
Figure 5:
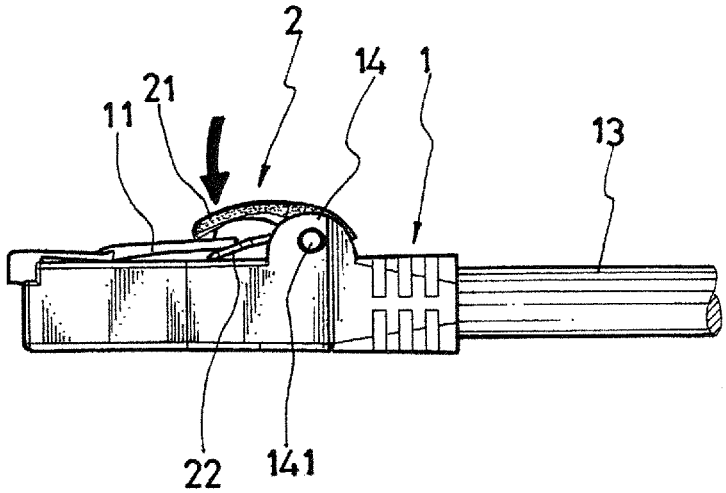
FIG. 5 shows a working view of the embodiment of the present invention, wherein the press member can drive the locking tab to move downwardly when the press member is depressed.
Figure 6:
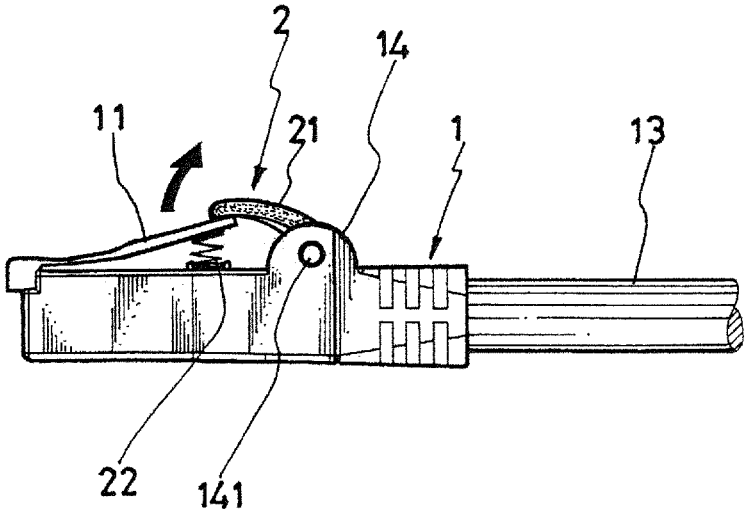
FIG. 6 shows a schematic view of another embodiment of the present invention, wherein the spring means is a coil spring.
Figure 7:
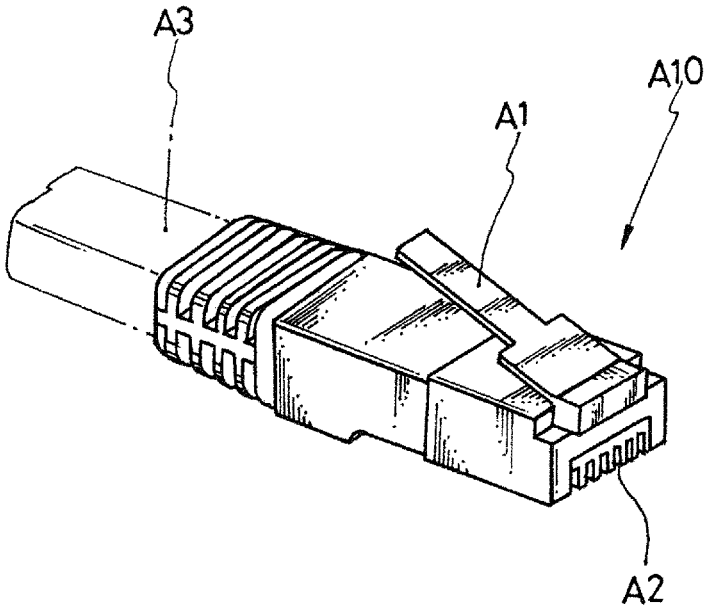
FIG.7 PRIOR ART
FIG. 7 shows a 3-dimensional view of a conventional communication connector.

As shown in FIGS. 4 and 5, the locking tab 11 is located between the press member 21 and the spring means 22, wherein the locking tab 11 is subject to an upward force from the spring means 22 and a downward force from the press member 21. Therefore, when the press member 21 is depressed for inserting the communication connector into a communication port, the press member 21 can be rotated in a forward direction so as to move the locking tab 11 downwardly, and at the same time, the spring means 22 can be compressed by the locking tab 11 to store spring energy (see FIG. 5). When the press member 21 is released after the communication connector is inserted into the communication port, the spring energy stored in the spring means 22 can drive the locking tab 11 to move upwardly, so that the locking tab 11 can return to its normal position. At the same time, the locking tab 11 can drive the press member 21 to rotate in a reverse direction until the stopper 212 being acted to limit a further rotation of the press member 21, thereby causing the press member 21 to be at a maximum angle (see FIG. 4). Alternatively, the spring means 22 can be implemented by other forms of spring, such as a coil spring (see FIG. 6) or a leaf spring, to accomplish the same purpose of the torsional spring as set forth.

In light of the foregoing, the present invention employs the press member 21 provided with pivot pins 211 (or pivot holes) fitted to the pivot holes 141 (or pivot pins) of the pivot portion 14, to allow the press member 21 to be rotated about the pivot portion 14. The press member 21 is provided with a stopper 212 at a rear end thereof to limit its reverse rotation. The present invention also employs spring means 22, which can be a torsional spring, a coil spring or a leaf spring, placed under the locking tab 11 to store energy when the press member 21 is depressed. Thus, the locking tab 11 can be moved by the spring means 22 to return to its normal position when the press member 21 is released. With the present invention, the spring means 22 can assist the locking tab 11 to return to its normal position, while the press member 21 can limit the locking tab 11 within an angle for protecting the locking tab 11 from being overly bent by improper external force. Such features make the present invention a robust and reliable communication connector.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. A communication connector, comprising:

a connector body having a locking tab at a front top portion thereof and fitted to a case at a rear portion thereof, wherein said case is provided with a pivot portion; and a tab operating mechanism including a press member and spring means, said press member having a rear end pivotally mounted to said pivot portion of said case and having a front end placed over said locking tab of said connector body, so that said press member is rotatable about said pivot portion to selectively press down the locking tab, said spring means being disposed between said case and said locking tab for biasing said locking tab from a lower position toward and against the press member so as to provide a spring force for driving the locking tab upward after the locking tab is pressed down by the press member, the rear end of said press member being provided with a stopper to limit said press member to a predetermined angle with respect to a top surface of said case.

2. The communication connector of claim 1, wherein said spring means is a torsional spring provided with a central hole that can be fitted around a pivot pin of said press member.

3. The communication connector of claim 2, wherein said spring means is a torsional spring provided with two central holes that are coaxially aligned and can be fitted around two pivot pins of said press member.

4. The communication connector of claim 2, wherein the torsional spring includes an extending leg at one side of its central hole.

* * * * *